US012060671B2

(12) United States Patent
Damtew et al.

(10) Patent No.: US 12,060,671 B2
(45) Date of Patent: Aug. 13, 2024

(54) WASHING MACHINE VENTILATION SYSTEMS AND METHODS

(71) Applicant: Haier US Appliance Solutions, Inc., Wilmington, DE (US)

(72) Inventors: Fikreadam Abebe Damtew, Louisville, KY (US); James Quentin Pollett, Louisville, KY (US); S. Neil Malone, Louisville, KY (US); Jerrod Aaron Kappler, Fisherville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 303 days.

(21) Appl. No.: 17/406,372

(22) Filed: Aug. 19, 2021

(65) Prior Publication Data

US 2023/0059400 A1 Feb. 23, 2023

(51) Int. Cl.

| | |
|---|---|
| ***D06F 23/02*** | (2006.01) |
| ***D06F 33/43*** | (2020.01) |
| ***D06F 39/12*** | (2006.01) |
| ***F24F 11/00*** | (2018.01) |
| *D06F 103/34* | (2020.01) |
| *D06F 105/46* | (2020.01) |
| *D06F 105/54* | (2020.01) |

(52) U.S. Cl.

CPC ..... *D06F 33/43* (2020.02); *D06F 39/12* (2013.01); *F24F 11/0001* (2013.01); *F24F 11/0008* (2013.01); *D06F 2103/34* (2020.02); *D06F 2105/46* (2020.02); *D06F 2105/54* (2020.02)

(58) Field of Classification Search

CPC ..... D06F 33/43; D06F 39/12; D06F 2105/46; D06F 2105/54; D06F 2013/34; F24F 11/0001; F24F 11/0008

USPC ..... 454/229

See application file for complete search history.

(56) References Cited

U.S. PATENT DOCUMENTS

| | | | | |
|---|---|---|---|---|
| 8,984,692 | B2 | 3/2015 | Balinski | |
| 10,870,940 | B2 | 12/2020 | Boutiette | |
| 11,085,137 | B2 * | 8/2021 | Salvi | D06F 37/304 |
| 11,208,755 | B2 * | 12/2021 | Balinski | D06F 39/04 |
| 11,319,654 | B2 * | 5/2022 | Malone | D06F 37/267 |

(Continued)

FOREIGN PATENT DOCUMENTS

| | | |
|---|---|---|
| CN | 109853187 A | 6/2019 |
| CN | 110485108 A | 11/2019 |

*Primary Examiner* — Avinash A Savani
*Assistant Examiner* — Dana K Tighe
(74) *Attorney, Agent, or Firm* — Dority & Manning, P.A.

(57) ABSTRACT

Washing machine appliance ventilation systems and methods include rotating a wash basket of the washing machine appliance for an ON period, whereby a flow of ambient air is drawn through an aperture in the washing machine appliance from an ambient environment into the wash basket. The systems and methods also include comparing a humidity within the washing machine appliance to a reference humidity value. When a difference between the humidity within the washing machine appliance and the reference humidity value is greater than a threshold, the step of rotating the wash basket for the ON period is repeated. When the difference between the humidity within the washing machine appliance and the reference humidity value is less than or equal to the threshold, the ventilation cycle or method is terminated.

20 Claims, 9 Drawing Sheets

(56) References Cited

U.S. PATENT DOCUMENTS

| | | | | |
|---|---|---|---|---|
| 2008/0078209 | A1* | 4/2008 | Kim | D06F 58/203 68/4 |
| 2008/0178397 | A1* | 7/2008 | Im | D06F 35/00 8/149.3 |
| 2013/0104607 | A1 | 5/2013 | Broitzman | |
| 2019/0218701 | A1 | 7/2019 | Strait | |

* cited by examiner

WASHING MACHINE VENTILATION SYSTEMS AND METHODS

FIELD OF THE INVENTION

The present subject matter relates generally to washing machine appliances, and more particularly to washing machine appliances having one or more ventilation features, such as a ventilations systems and/or are operable to perform a ventilation cycle.

BACKGROUND OF THE INVENTION

Washing machine appliances generally include a wash tub for containing water or wash fluid (e.g., water, detergent, bleach, or other wash additives). A basket is rotatably mounted within the wash tub and defines a wash chamber for receipt of articles for washing. During normal operation of such washing machine appliances, the wash fluid is directed into the wash tub and onto articles within the wash chamber of the basket. The basket or an agitation element can rotate at various speeds to agitate articles within the wash chamber, to wring wash fluid from articles within the wash chamber, etc.

Some existing washing machine appliances, such as horizontal axis washing machines, are provided with one or more ventilation features. Such features may allow a washing machine appliance to exchange air between the wash tub and the ambient environment. The exchange of air may be necessary to prevent moisture from accumulating within the tub. For example, if the tub is not ventilated, moist, stagnant air may form within the washing machine.

Although ventilation features may aid in preventing moisture from accumulating within existing washing machine appliances (e.g., when a door to the washing machine is open), such existing appliances may have certain disadvantages. For example, airflow through such washing machine appliances is generally limited, especially when the door is closed. Although leaving the door to the tub open may improve airflow, and thereby help prevent moisture from accumulating, this may be undesirable for various reasons. For instance, leaving the door open may limit usable space within a room or make it impossible to cover or hide the washing machine appliance. Moreover, leaving the washing machine appliance door open may be inconvenient or create an unseemly appearance. Even if a door to a washing machine appliance is left open, moisture may still become trapped in certain portions of the washing machine appliance or ventilation features.

As a result, further advances are necessary to improve performance and reduce residual moisture within washing machine appliances. In particular, it may be advantageous to provide one or more features for aiding in ventilation or reducing the accumulation of residual moisture within a washing machine appliance.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a method of ventilating a washing machine appliance is provided. The washing machine appliance has a cabinet, an aperture defined through the cabinet, a wash tub positioned within the cabinet, and a wash basket rotatably mounted within the wash tub. The wash basket is accessible through an opening in the cabinet. The washing machine appliance also includes a door pivotably mounted to the cabinet such that the door is pivotable between an open position and a closed position. The door permits access to the wash basket through the opening when in the open position and encloses the wash basket within the cabinet when in the closed position. The aperture is open to an ambient environment external to the cabinet when the door is in the closed position. The method includes rotating the wash basket for an ON period. As a result of such rotation, a flow of ambient air is drawn through the aperture from the ambient environment into the wash basket, and the flow of ambient air is urged into a vent line extending between the wash basket and the cabinet. The vent line is downstream of the wash basket with respect to the flow of ambient air through the aperture from the ambient environment. The method further includes comparing a humidity within the washing machine appliance to a reference humidity value. When a difference between the humidity within the washing machine appliance and the reference humidity value is greater than a threshold, the step of rotating the wash basket for the ON period is repeated. When the difference between the humidity within the washing machine appliance and the reference humidity value is less than or equal to the threshold, the method is terminated.

In another exemplary aspect of the present disclosure, a washing machine appliance is provided. The washing machine appliance has a cabinet, an aperture defined through the cabinet, a wash tub positioned within the cabinet, and a wash basket rotatably mounted within the wash tub. The wash basket is accessible through an opening in the cabinet. The washing machine appliance also includes a door pivotably mounted to the cabinet such that the door is pivotable between an open position and a closed position. The door permits access to the wash basket through the opening when in the open position and encloses the wash basket within the cabinet when in the closed position. The washing machine appliance further includes a vent line extending between the wash basket and the cabinet such that the vent line is downstream of the wash basket with respect to the flow of ambient air from the ambient environment external to the cabinet through the aperture. The washing machine appliance also include a controller. The controller is operable to perform a ventilation cycle. The ventilation cycle includes rotating the wash basket for an ON period, which causes ambient air to be drawn through the aperture from the ambient environment into the wash basket. The ventilation cycle further includes comparing a humidity within the washing machine appliance to a reference humidity value. When a difference between the humidity within the washing machine appliance and the reference humidity value is greater than a threshold, the step of rotating the wash basket for the ON period is repeated. When the difference between the humidity within the washing machine appliance and the reference humidity value is less than or equal to the threshold, the ventilation cycle is terminated.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
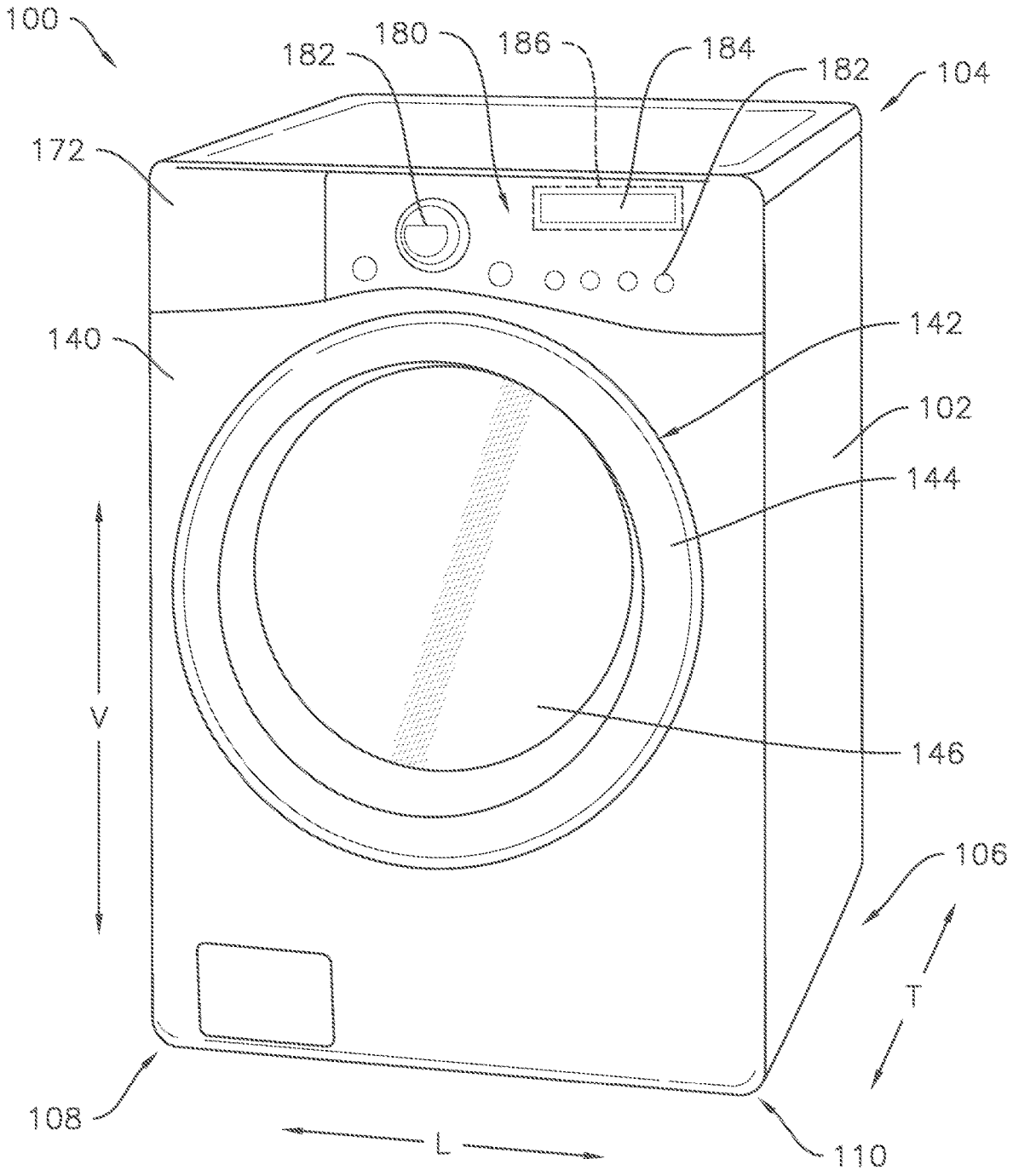
FIG. 1 provides a perspective view of a washing machine appliance according to one or more exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In order to aid understanding of this disclosure, several terms are defined below. The defined terms are understood to have meanings commonly recognized by persons of ordinary skill in the arts relevant to the present invention. The terms "includes" and "including" are intended to be inclusive in a manner similar to the term "comprising." Similarly, the term "or" is generally intended to be inclusive (i.e., "A or B" is intended to mean "A or B or both"). The terms "first," "second," and "third" may be used interchangeably to distinguish one element from another and are not intended to signify location or importance of the individual elements. Terms such as "inner" and "outer" refer to relative directions with respect to the interior and exterior of the washing machine appliance, and in particular the wash basket therein. For example, "inner" or "inward" refers to the direction towards the interior of the washing machine appliance. Terms such as "left," "right," "front," "back," "top," or "bottom" are used with reference to the perspective of a user accessing the washing machine appliance. For example, a user stands in front of the washing machine appliance to open the door and reaches into the wash basket to access items therein. Furthermore, it should be appreciated that as used herein, terms of approximation, such as "approximately," "substantially," or "about," refer to being within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise.

Figure 2:
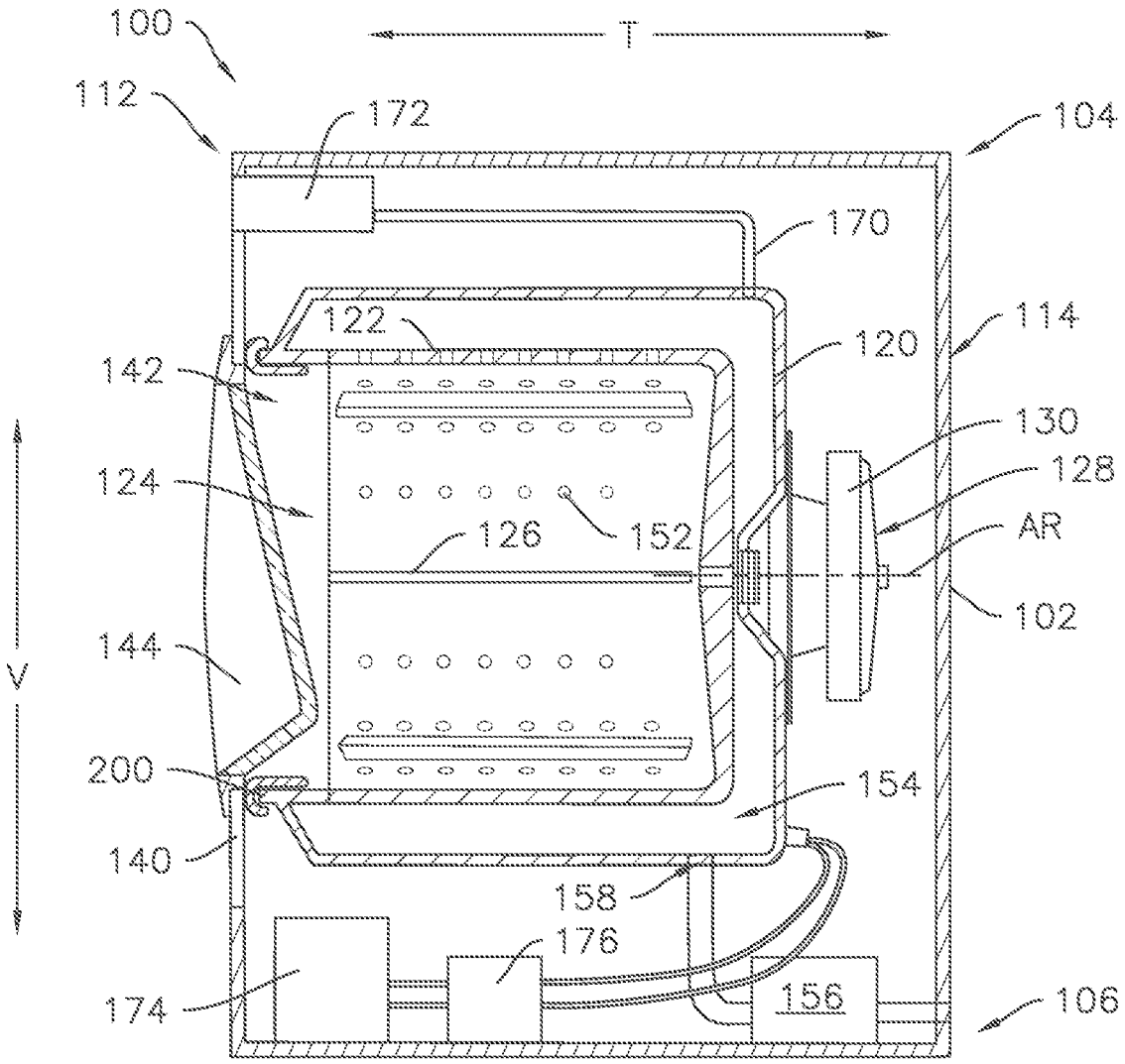
FIG. 2 provides a cross-sectional side view of the exemplary washing machine appliance.

Referring now to the figures, FIG. 1 is a perspective view of an exemplary horizontal axis washing machine appliance 100 and FIG. 2 is a side cross-sectional view of washing machine appliance 100. As illustrated, washing machine appliance 100 generally defines a vertical direction V, a lateral direction L, and a transverse direction T, each of which is mutually perpendicular, such that an orthogonal coordinate system is generally defined. Washing machine appliance 100 includes a cabinet 102 that extends between a top 104 and a bottom 106 along the vertical direction V, between a left side 108 and a right side 110 along the lateral direction L, and between a front 112 and a rear 114 along the transverse direction T.

Referring to FIG. 2, a wash tub 120 is positioned within cabinet 102 and is generally configured for retaining wash fluids during an operating cycle. As used herein, "wash fluid" may refer to water, detergent, fabric softener, bleach, or any other suitable wash additive or combination thereof. A wash basket 122 is received within wash tub 120 and defines a wash chamber 124 that is configured for receipt of articles for washing. More specifically, wash basket 122 is rotatably mounted within wash tub 120 such that it is rotatable about an axis of rotation AR. According to the illustrated embodiment, the axis of rotation is substantially parallel to the transverse direction T. In this regard, washing machine appliance 100 is generally referred to as a "horizontal axis" or "front load" washing machine appliance 100. However, it should be appreciated that aspects of the present subject matter may be used within the context of a vertical axis or top load washing machine appliance as well.

Wash basket 122 may define one or more agitator features that extend into wash chamber 124 to assist in agitation and cleaning articles disposed within wash chamber 124 during operation of washing machine appliance 100. For example, as illustrated in FIG. 2, a plurality of ribs 126 extends from basket 122 into wash chamber 124. In this manner, for example, ribs 126 may lift articles disposed in wash basket 122 during rotation of wash basket 122.

Washing machine appliance 100 includes a drive assembly 128 which is coupled to wash tub 120 and is generally configured for rotating wash basket 122 during operation, e.g., such as during an agitation or spin cycle. More specifically, as best illustrated in FIG. 2, drive assembly 128 may include a motor assembly 130 that is in mechanical communication with wash basket 122 to selectively rotate wash basket 122 (e.g., during an agitation or a rinse cycle of washing machine appliance 100). According to the illustrated embodiment, motor assembly 130 is a pancake motor. However, it should be appreciated that any suitable type, size, or configuration of motors may be used to rotate wash basket 122 according to alternative embodiments. In addition, drive assembly 128 may include any other suitable number, types, and configurations of support bearings or drive mechanisms.

Referring generally to FIGS. 1 and 2, cabinet 102 also includes a front panel 140 that defines an opening 142 that permits user access to wash basket 122. More specifically, washing machine appliance 100 includes a door 144 that is positioned over opening 142 and is rotatably, e.g., pivotably, mounted to front panel 140 (e.g., about a door axis that is substantially parallel to the vertical direction V). In this manner, door 144 permits selective access to opening 142 by being movable between an open position (not shown) facilitating access to a wash tub 120 and a closed position (FIG. 1) prohibiting access to wash tub 120. For example, when the door 144 is in the closed position, the wash tub 120 may be generally enclosed (e.g., at least 90% enclosed and at least 90% surrounded on all sides, such as fully enclosed with the exception of a vent line 190 and/or vent aperture 202 as will be described below) by the door 144 and the cabinet 102. A gasket 200 may be provided in the opening 142 and the gasket 200 may sealingly engage the door 144 when the door 144 is in the closed position. For example, the gasket 200 may extend between the tub 120 and the front panel 140, e.g., generally along the transverse direction T and may extend about or around the opening 142 such that the gasket 200 is covered by the door 144 when the door 144 is in the closed position, and the gasket 200 may promote sealing between the door 144 and the cabinet 102, e.g., the front panel 140 of the cabinet 102.

In some embodiments, a window 146 in door 144 permits viewing of wash basket 122 when door 144 is in the closed position (e.g., during operation of washing machine appliance 100). Door 144 also includes a handle (not shown) that, for example, a user may pull when opening and closing door 144. Further, although door 144 is illustrated as mounted to front panel 140, it should be appreciated that door 144 may be mounted to another side of cabinet 102 or any other suitable support according to alternative embodiments.

Referring again to FIG. 2, wash basket 122 also defines a plurality of perforations 152 in order to facilitate fluid communication between an interior of basket 122 and wash tub 120. A sump 154 is defined by wash tub 120 at a bottom of wash tub 120 along the vertical direction V. Thus, sump 154 is configured for receipt of, and generally collects, wash fluid during operation of washing machine appliance 100. For example, during operation of washing machine appliance 100, wash fluid may be urged (e.g., by gravity) from basket 122 to sump 154 through the plurality of perforations 152. A pump assembly 156 is located beneath wash tub 120 for gravity assisted flow when draining wash tub 120 (e.g., via a drain 158). Pump assembly 156 is also configured for recirculating wash fluid within wash tub 120. Accordingly, pump assembly 156 may also be referred to or include a drain pump and/or a circulation pump.

Referring still to FIGS. 1 and 2, in some embodiments, washing machine appliance 100 may include an additive dispenser or spout 170. For example, spout 170 may be in fluid communication with a water supply (not shown) in order to direct fluid (e.g., clean water) into wash tub 120. Spout 170 may also be in fluid communication with the sump 154. For example, pump assembly 156 may direct wash fluid disposed in sump 154 to spout 170 in order to circulate wash fluid in wash tub 120.

As illustrated, a detergent drawer 172 may be slidably mounted within front panel 140. Detergent drawer 172 receives a wash additive (e.g., detergent, fabric softener, bleach, or any other suitable liquid or powder) and directs the fluid additive to wash chamber 124 during operation of washing machine appliance 100. According to the illustrated embodiment, detergent drawer 172 may also be fluidly coupled to spout 170 to facilitate the complete and accurate dispensing of wash additive.

In some embodiments, an optional bulk reservoir 174 may be disposed within cabinet 102. Bulk reservoir 174 may be configured for receipt of fluid additive for use during operation of washing machine appliance 100. Moreover, bulk reservoir 174 may be sized such that a volume of fluid additive sufficient for a plurality or multitude of wash cycles of washing machine appliance 100 (e.g., five, ten, twenty, fifty, or any other suitable number of wash cycles) may fill bulk reservoir 174. Thus, for example, a user can fill bulk reservoir 174 with fluid additive and operate washing machine appliance 100 for a plurality of wash cycles without refilling bulk reservoir 174 with fluid additive. A reservoir pump 176 may be configured for selective delivery of the fluid additive from bulk reservoir 174 to wash tub 120.

A control panel 180 including a plurality of input selectors 182 may be coupled to front panel 140. Control panel 180 and input selectors 182 collectively form a user interface input for operator selection of machine cycles and features. A display 184 of control panel 180 indicates selected features, operation mode, a countdown timer, and/or other items of interest to appliance users regarding operation.

Operation of washing machine appliance 100 is controlled by a processing device or a controller 186 that is operatively coupled to control panel 180 for user manipulation to select washing machine cycles and features. In response to user manipulation of control panel 180, controller 186 operates the various components of washing machine appliance 100 to execute selected machine cycles and features. Controller 186 may include a memory and microprocessor, such as a general or special purpose microprocessor operable to execute programming instructions or micro-control code associated with methods described herein. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 186 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 180 may be in communication with controller 186 via one or more signal lines or shared communication busses to provide signals to and/or receive signals from the controller 186.

In addition, the memory or memory devices of the controller 186 can store information and/or data accessible by the one or more processors, including instructions that can be executed by the one or more processors. It should be appreciated that the instructions can be software written in any suitable programming language or can be implemented in hardware. Additionally, or alternatively, the instructions can be executed logically and/or virtually using separate threads on one or more processors.

For example, controller 186 may be operable to execute programming instructions or micro-control code associated with an operating cycle of washing machine appliance 100. In this regard, the instructions may be software or any set of instructions that when executed by the processing device, cause the processing device to perform operations, such as running one or more software applications, displaying a user interface, receiving user input, processing user input, etc. Moreover, it should be noted that controller 186 as disclosed herein is capable of and may be operable to perform any methods, method steps, or portions of methods as disclosed herein. For example, in some embodiments, methods disclosed herein may be embodied in programming instructions stored in the memory and executed by controller 186.

The memory devices may also store data that can be retrieved, manipulated, created, or stored by the one or more processors or portions of controller 186. The data can include, for instance, data to facilitate performance of methods described herein. The data can be stored locally (e.g., on controller 186) in one or more databases and/or may be split up so that the data is stored in multiple locations. In addition, or alternatively, the one or more database(s) can be connected to controller 186 through any suitable network(s), such as through a high bandwidth local area network (LAN) or wide area network (WAN). In this regard, for example, controller 186 may further include a communication module or interface that may be used to communicate with one or more other component(s) of washing machine appliance 100, controller 186, an external appliance controller, or any other suitable device, e.g., via any suitable communication lines or network(s) and using any suitable communication protocol. The communication interface can include any suitable components for interfacing with one or more network(s), including for example, transmitters, receivers, ports, controllers, antennas, or other suitable components.

In exemplary embodiments, during operation of washing machine appliance 100, laundry items are loaded into wash basket 122 through opening 142, and a wash operation is initiated through operator manipulation of input selectors 182. For example, a wash cycle may be initiated such that wash tub 120 is filled with water, detergent, or other fluid additives (e.g., via detergent drawer 172 or bulk reservoir 174). One or more valves (not shown) can be controlled by washing machine appliance 100 to provide for filling wash basket 122 to the appropriate level for the amount of articles being washed or rinsed. By way of example, once wash basket 122 is properly filled with fluid, the contents of wash basket 122 can be agitated (e.g., with ribs 126) for an agitation phase of laundry items in wash basket 122. During the agitation phase, the basket 122 may be motivated about the axis of rotation AR at a set speed (e.g., first speed or tumble speed). As the basket 122 is rotated, articles within the basket 122 may be lifted and permitted to drop therein.

After the agitation phase of the washing operation is completed, wash tub 120 can be drained, e.g., by drain pump assembly 156. Laundry articles can then be rinsed (e.g., through a rinse cycle) by again adding fluid to wash tub 120, depending on the particulars of the cleaning cycle selected by a user. Ribs 126 may again provide agitation within wash basket 122. One or more spin cycles may also be used. In particular, a spin cycle may be applied after the wash cycle or after the rinse cycle in order to wring wash fluid from the articles being washed. During a spin cycle, basket 122 is rotated at relatively high speeds. For instance, basket 122 may be rotated at one set speed (e.g., second speed or pre-plaster speed) before being rotated at another set speed (e.g., third speed or plaster speed). As would be understood, the pre-plaster speed may be greater than the tumble speed and the plaster speed may be greater than the pre-plaster speed. Moreover, agitation or tumbling of articles may be reduced as basket 122 increases its rotational velocity such that the plaster speed maintains the articles at a generally fixed position relative to basket 122. After articles disposed in wash basket 122 are cleaned (or the washing operation otherwise ends), a user can remove the articles from wash basket 122 (e.g., by opening door 144 and reaching into wash basket 122 through opening 142).

During such operations, the gasket 200 may help to contain wash fluid within the cabinet 102, particularly within the tub 120. As generally shown in FIG. 2, the gasket 200 may be positioned between the door 144 and the tub 120, e.g., when the door 144 is in the closed position as in FIG. 2. Thus, the gasket 200 may sealingly engage the door 144 when the door 144 is in the closed position. In general, the gasket 200 sealingly engages the cabinet 102, in particular the opening 142 thereof, the tub 120, and the door 144. For example, the gasket 200 may extend around the opening 142 along a perimeter, e.g., circumference, of the opening 142 and may extend between the cabinet 102 and the wash tub 120 along a longitudinal axis, such as along or generally parallel to the transverse direction T.

After completion of the wash cycle, as described above, moisture can become trapped within the washing machine appliance 100, e.g., in wash tub 120 and/or gasket 200. This may promote growth and/or spread of odors, mold, and/or mildew on the components of washing machine appliance 100 and on the laundry articles within wash basket 122. Accordingly, in accordance with exemplary aspects of the present disclosure, after or between such wash cycles, washing machine appliance 100 may be operated in a ventilation cycle to remove moisture from within the washing machine appliance 100. Exemplary systems and methods for performing such a cycle are described below.

It should be appreciated that the present subject matter is not limited to any particular style, model, or configuration of washing machine appliance. The exemplary embodiment depicted in FIGS. 1 and 2 is simply provided for illustrative purposes only. While described in the context of a specific embodiment of horizontal axis washing machine appliance 100, it will be understood that horizontal axis washing machine appliance 100 is provided by way of example only. Other washing machine appliances having different configurations, different appearances, and/or different features may also be utilized with the present subject matter as well. For example, different locations may be provided for the user interface, different configurations may be provided, e.g., vertical axis washing machines, and other differences may be applied as well.

Figure 3:
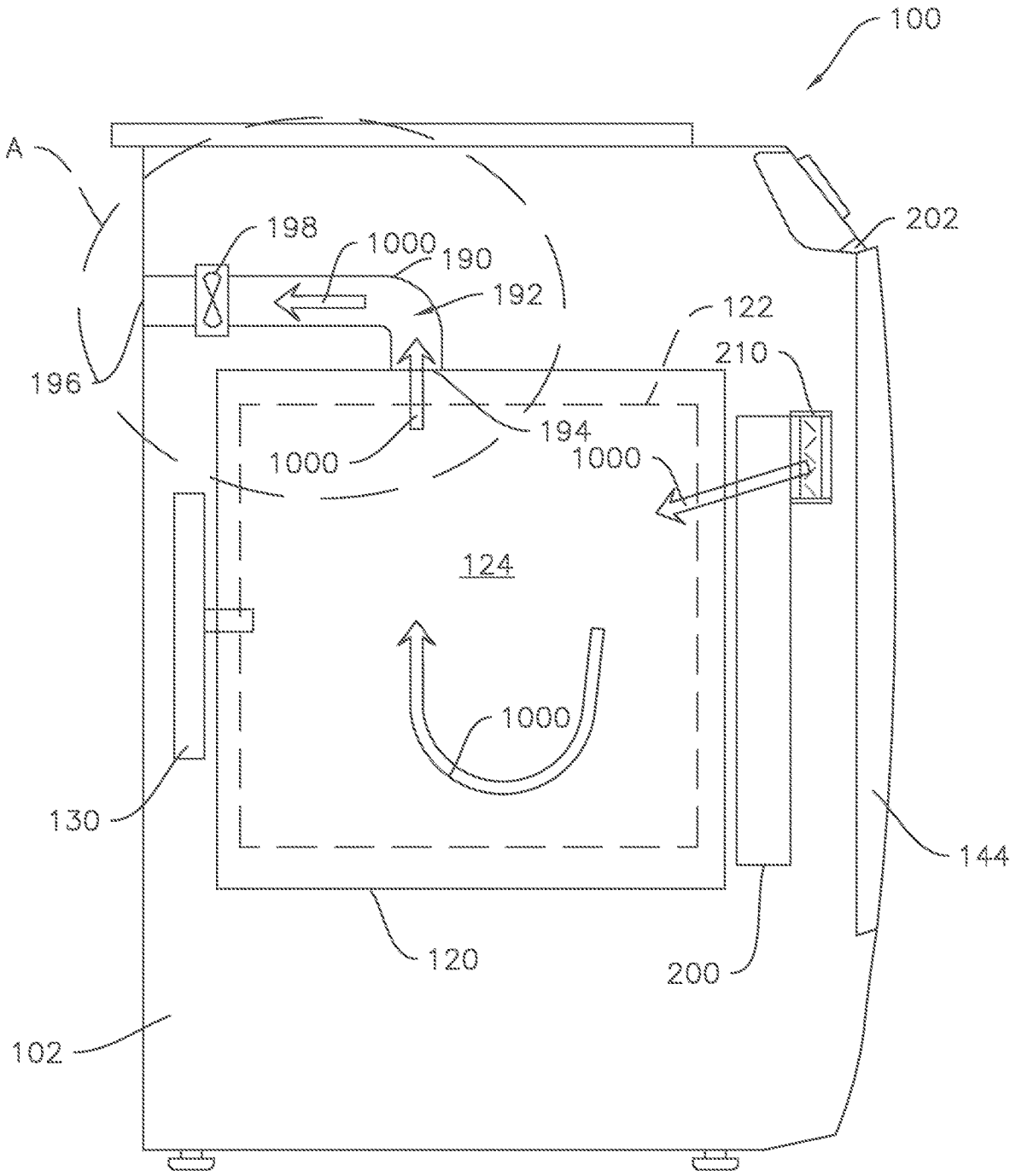
FIG. 3 provides a schematic side view of an exemplary washing machine appliance according to one or more exemplary embodiments of the present disclosure.

As illustrated in FIG. 3, in some embodiments, a ventilation line 190 is provided within washing machine appliance 100. In particular, ventilation line 190 may be enclosed within cabinet 102. As shown in FIG. 3, exemplary embodiments include ventilation line 190 at a position in fluid communication between tub 120 and the surrounding region (e.g., the ambient environment outside of or immediately surrounding cabinet 102, the enclosed volume of cabinet 102 surrounding tub 120, etc.). Generally, it is understood that ventilation line 190 may be provided as any suitable pipe or conduit (e.g., having non-permeable wall) for directing air therethrough. When assembled, ventilation line 190 defines an air path 192 from tub 120 and within or through cabinet 102 (e.g., to the ambient environment outside of cabinet 102). Specifically, air path 192 extends from a ventilation inlet 194, through cabinet 102, and to a ventilation outlet 196. In some embodiments, ventilation inlet 194 is defined through a top portion of wash tub 120 and ventilation outlet 196 is defined through an upper portion of cabinet 102. Thus, air path 192 may extend from the top portion of tub 120 to an upper portion of cabinet 102. Optionally, ventilation inlet 194 may be positioned below ventilation outlet 196 along a vertical direction V. Advantageously, a convective airflow may be naturally motivated from wash tub 120, through air path 192, and to the ambient environment. Also, such airflow may be aided or urged through the washing machine appliance 100 by rotating the wash basket 122. Additionally or alternatively, splashing of wash fluid and the collection of moisture within air path 192 may be prevented. However, any other suitable configuration may be provided to facilitate the flow of air from tub 120 and, for example, to the ambient environment.

Although a convective airflow may be facilitated, optional embodiments further include a fan or blower 198. Specifically, fan 198 may be provided in fluid communication with ventilation line 190 to motivate an active airflow therethrough. For instance, fan 198 may be mounted within ventilation line 190 to selectively rotate and draw air from wash tub 120, through ventilation inlet 194, and to ventilation outlet 196 (e.g., to output an airflow from tub 120 to the ambient environment).

A cabinet aperture 202 may be defined through front panel 140 as an inlet for ambient air to flow from outside of the cabinet 102 to the inside of the cabinet 102, e.g., to and through the tub 120. Notably, in the disclosed embodiments, air 1000 (e.g., an ambient airflow) may flow between tub 120 and the ambient environment through cabinet aperture 202 and/or vent line 190 even while door 144 remains closed.

A vent damper 210 may be provided to selectively control an airflow between tub 120 and, for example, the ambient environment. Generally, vent damper 210 is in communication with wash tub 120 and/or ventilation line 190 (i.e., in fluid communication with air path 192). In certain embodiments, vent damper 210 is enclosed, at least in part, within cabinet 102. Vent damper 210 may be selectively controlled or operated to limit or obstruct the flow of air from the ambient environment into the interior of the cabinet 102, such as to the wash tub 120, via the aperture 202 during certain operations, phases, or cycles. Thus, vent damper 210 may selectively limit airflow between tub 120 and the ambient environment, such as airflow from the ambient environment via the aperture 202.

The damper 210 may be positioned downstream of the aperture 202, e.g., between the aperture 202 and the wash tub 120 and/or between the aperture 202 and the gasket 200. Thus, opening the damper 210 may permit fluid communication, e.g., air flow, between internal components of the washing machine appliance 100, e.g., the wash tub 120 and/or the wash basket 122, and the ambient environment external to the cabinet 102. Thus, the damper 210 may be upstream of the internal components, e.g., wash basket 122, with respect to a flow of ambient air 1000 from the ambient environment external to the cabinet 102 through the washing machine appliance 100. As may be seen in FIG. 3, the flow of ambient air 1000 from the ambient environment external to the cabinet 102 through the washing machine appliance 100 may enter the washing machine appliance 100 through the aperture 202, flow through the damper 210, into and through the wash tub 120, e.g., wash basket 122 and wash chamber 124 therein, and may exit the washing machine appliance 100 via the vent line 190, e.g., by flowing into the vent line 190 at the ventilation inlet 194 from the wash tub 120, flowing through the vent line 190, and returning to the ambient environment from the vent line 190 via the ventilation outlet 196. In some embodiments, such air flow may be aided or urged by fan 198. In additional embodiments, the air flow through the washing machine appliance 100, as illustrated by arrows 1000, may be provided by convective flow and/or rotation of the wash basket 122 without the use or presence of a fan. Such rotation of the wash basket 122, including the ribs 126 therein, may push the air 1000 around to promote circulation of the ambient air 1000 through the washing machine appliance 100, e.g., into and through the wash basket 122. In some embodiments, the fan 198 may not be included, and the flow of ambient air 1000 through the washing machine appliance 100 may be provided solely by natural convection and/or rotation of the wash basket 122.

Figure 4:
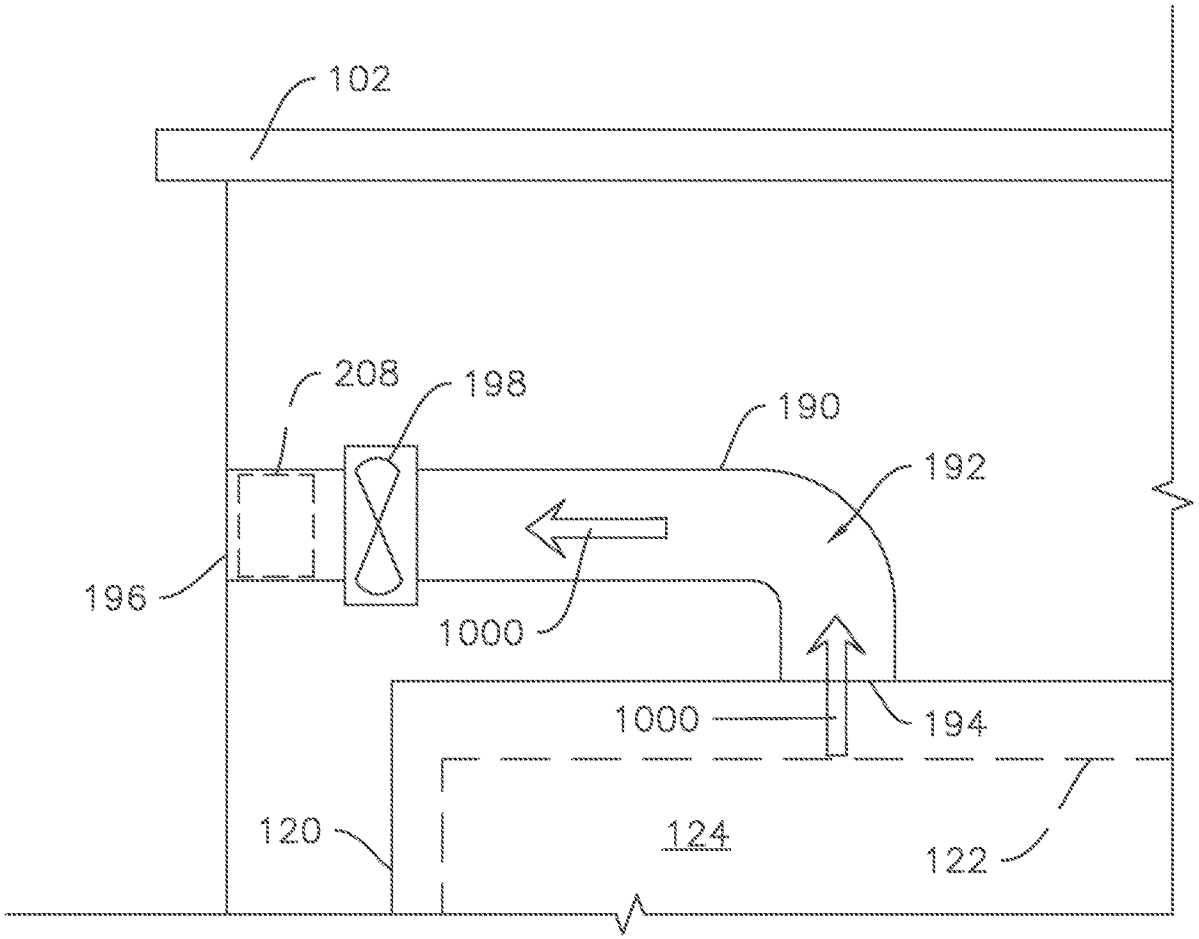
FIG. 4 provides an enlarged view of a portion of the washing machine appliance of FIG. 3 according to one or more exemplary embodiments of the present disclosure.
Figure 5:
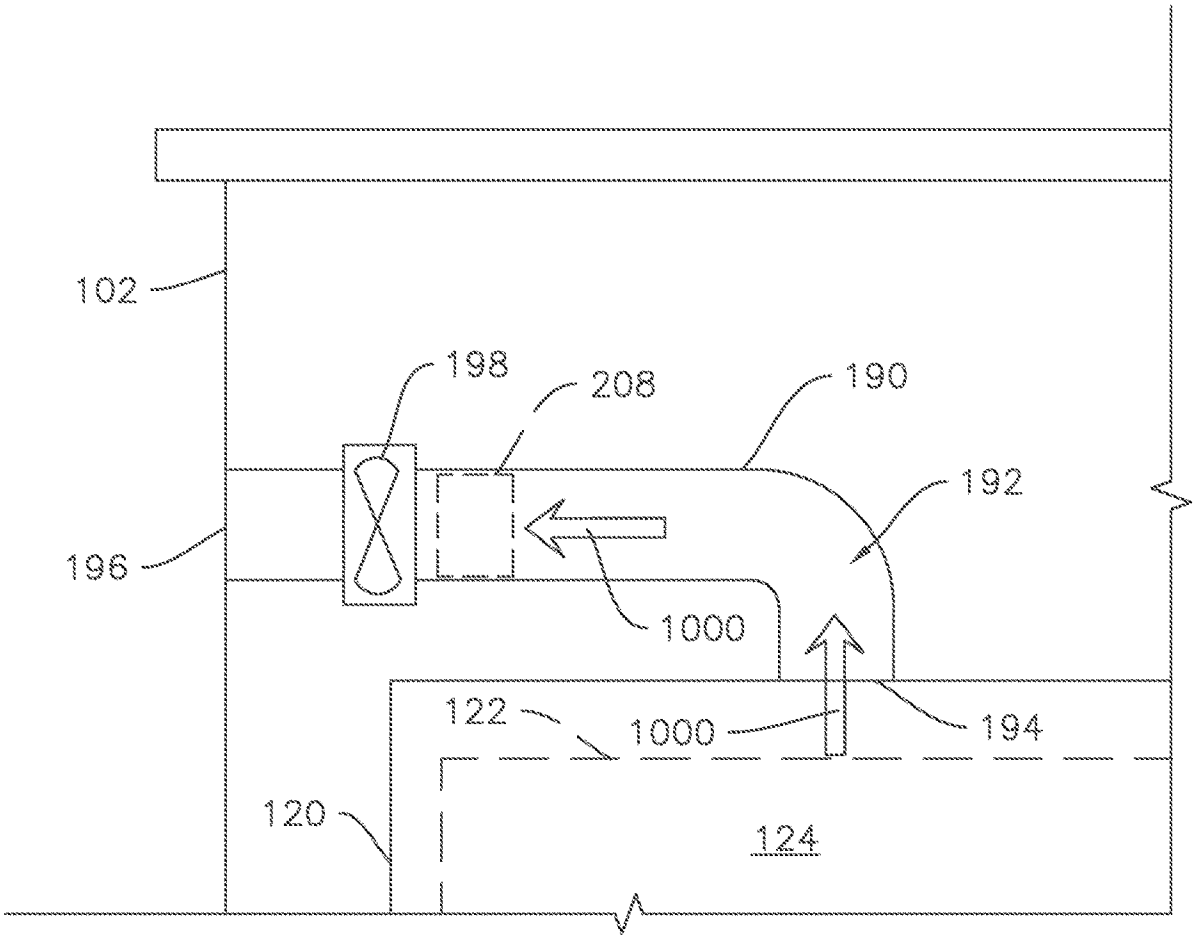
FIG. 5 provides an enlarged view of a portion of the washing machine appliance of FIG. 3 according to one or more additional exemplary embodiments of the present disclosure.
Figure 6:
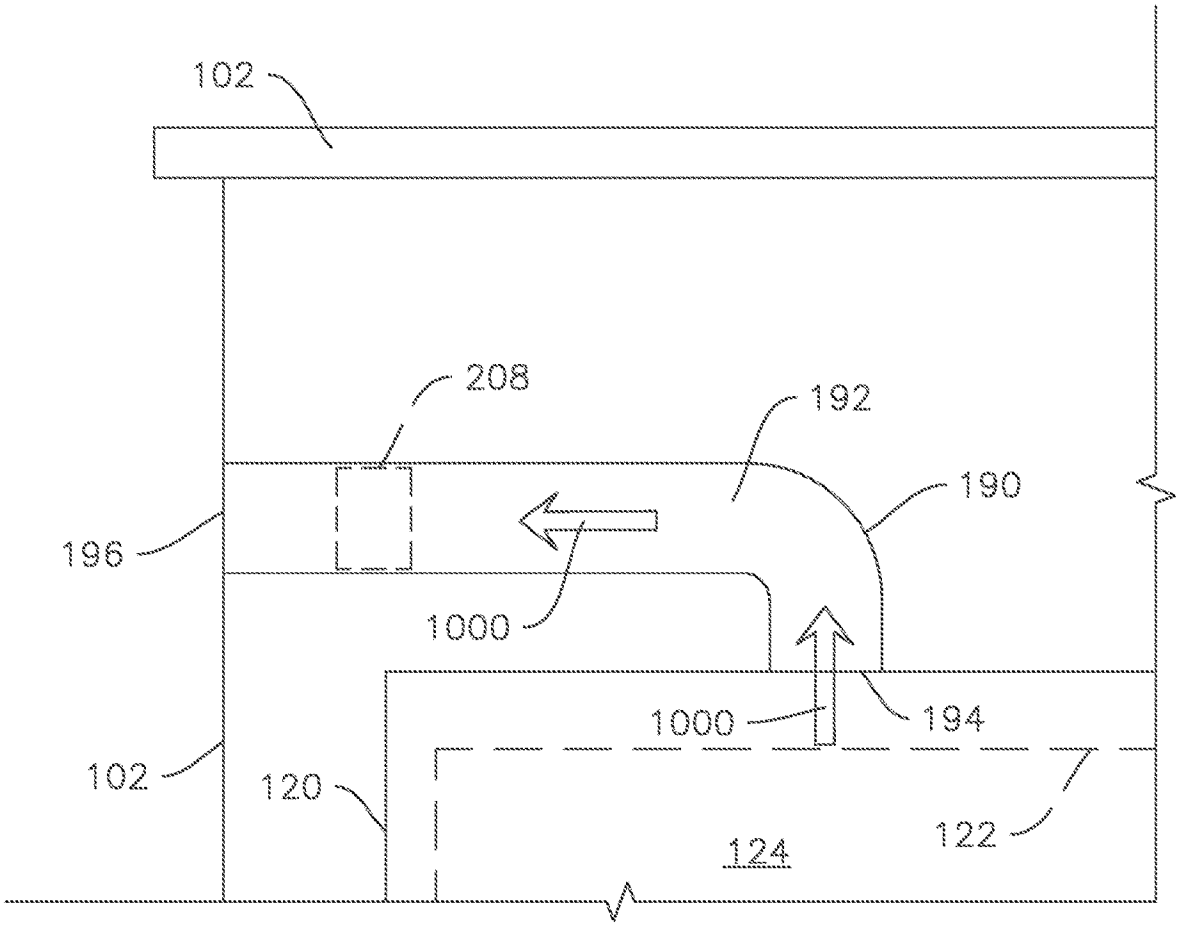
FIG. 6 provides an enlarged view of a portion of the washing machine appliance of FIG. 3 according to one or more further exemplary embodiments of the present disclosure.

FIGS. 4-6 illustrate enlarged views of a portion of the washing machine appliance 100 of FIG. 3, the portion is generally indicated by the oval A in FIG. 3. As illustrated in FIGS. 4-6, the washing machine appliance 100 may also include a humidity sensor 208. In some embodiments, the humidity sensor 208 may be a single humidity sensor 208, e.g., may be the only humidity sensor provided in the washing machine appliance 100, and may be operable to measure both an internal humidity level, e.g., a humidity within the washing machine appliance 100 (such as within the cabinet 102 thereof, such as within the wash tub 120 and/or wash basket 122) and a external humidity level, e.g., a humidity outside of the cabinet 102, such as a humidity of an ambient environment external to the cabinet 102. Humidity sensor 208 may be positioned in any suitable location within washing machine appliance 100. Humidity sensor 208 may be any suitable sensor capable of sensing or measuring the humidity or relative humidity in the air. For instance, humidity sensor 208 may be a capacitive, resistive, or thermal sensor.

As mentioned above, the controller 186 may be in operative communication with various other components of the washing machine appliance 100. In particular, controller 186 is in operative communication with humidity sensor 208, fan 198 (when the fan 198 is provided), damper 210, and motor 130. Accordingly, controller 186 may receive signals from and rout signals to these various components. For instance, controller 186 may receive signals from humidity sensor 208 that are indicative of the humidity or relative humidity of the air measured by the humidity sensor 208. Such signals may be used to make decisions as to whether to activate motor 130 to rotate wash basket 122, e.g., to facilitate air flow through the wash tub 120. Controller 186 can receive the signals directly or indirectly from sensor 208. Moreover, controller 186 may send signals to motor 130, e.g., to rotate basket 122, to fan 198, e.g., to blow air within and/or through vent line 190, or controller 186 may send signals to damper 210 to open or close.

In some embodiments, e.g., as illustrated in FIG. 4, humidity sensor 208 may be positioned proximate the ambient environment, such as proximate the ventilation outlet 196. For example, in embodiments which include the fan 198, the humidity sensor 208 may be proximate the ambient environment in that the humidity sensor 208 is downstream of the fan 198, e.g., is between the fan 198 and the ventilation outlet 196. As another example, the humidity sensor 208 may be proximate the ambient environment in that the humidity sensor 208 is closer to the ventilation outlet 196 than to the ventilation inlet 194, such as, where a length of the ventilation line 190 is defined from the ventilation inlet 194 to the ventilation outlet 196, the humidity sensor 208 may be positioned at the ventilation outlet 196 or separated from the ventilation outlet 196 by a distance which is ten percent or less of the length of the ventilation line 190. In such embodiments, the humidity sensor 208 may be operable to measure ambient humidity whenever the washing machine appliance 100 is idle, e.g., when the washing machine appliance 100 is not performing a cycle such as a wash cycle. In particular, it may be advantageous to measure the ambient humidity when the washing machine appliance 100 is idle prior to the first wash cycle of the day, and such ambient humidity measurement may be stored or recorded, e.g., in a memory of the controller 186.

In some embodiments, e.g., as illustrated in FIGS. 5 and 6, humidity sensor 208 may be positioned inside the vent line 190 and away from the ambient environment. For example, in embodiments such as FIG. 5 which include the fan 198, the humidity sensor 208 may be away from the ambient environment in that the humidity sensor 208 is upstream of the fan 198, e.g., where the fan 198 is between the humidity sensor 208 and the ventilation outlet 196, such that the humidity sensor 208 is separated from the ambient environment by the fan 198. As another example, the humidity sensor 208 may be away from the ambient environment in that the humidity sensor 208 separated from the ventilation outlet 196 by a distance which is more than ten percent of the length of the ventilation line 190. In such embodiments, the humidity sensor 208 may be operable to measure ambient humidity whenever the washing machine appliance 100 is idle, assuming that the ambient humidity and the humidity inside the washing machine appliance are approximately the same given sufficient time to equilibrate after a most recent wash cycle. In particular, it may be advantageous to measure the ambient humidity when the washing machine appliance 100 is idle prior to the first wash cycle of the day in order to ensure sufficient time for the humidity to equilibrate, and such ambient humidity measurement may be stored or recorded, e.g., in a memory of the controller 186.

Additionally, in at least some embodiments, in particular those embodiments where the humidity sensor 208 is positioned away from the outlet 196, the humidity sensor 208 may be operable to measure the ambient humidity when ambient air is drawn into the vent line 190, e.g., in the reverse direction of the normal air flow path through the washing machine appliance 100. For example, in embodiments which include the fan 198, the fan 198 may be operable in two directions, e.g., may be a reversible fan, whereby the fan 198 may be operable to spin in a reverse direction in order to draw ambient air into the vent line 190 via the ventilation outlet 196, whereby the humidity sensor 208 may measure an ambient humidity when the fan 198 is operating in the reverse direction. In additional embodiments, such as but not limited to embodiments where there is no fan in the vent line 190, e.g., as illustrated in FIG. 6, the washing machine appliance 100 may be operable to draw ambient air in through the ventilation outlet 196 (which, as noted above, is opposite the normal flow direction of the flow of air through the washing machine appliance 100) when the door 144 is closed, by closing the damper 210 and activating the pump assembly 156, e.g., activating a drain pump. With the door 144 and the damper 210 both closed, the vent line 190 is the only point of ingress or egress for air to or from the interior of the washing machine appliance 100. Thus, activating the pump creates a negative pressure within the wash tub 120, thereby drawing ambient air in through the vent line 190, e.g., past the humidity sensor 208 whereby the humidity sensor 208 may measure an ambient humidity when the door 144 and the damper 210 are both closed and the pump 156 is activated.

Figure 7:
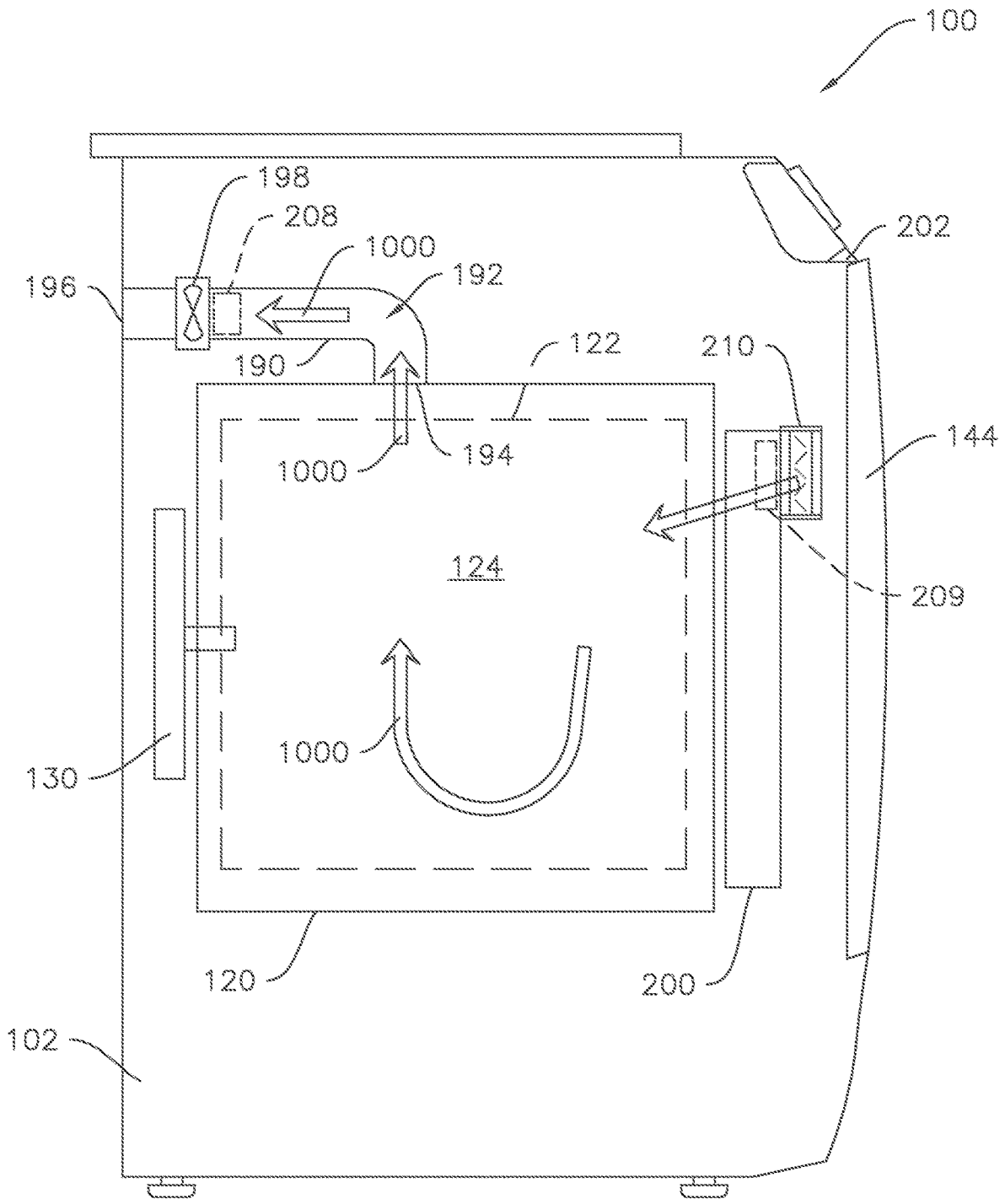
FIG. 7 provides a schematic side view of an exemplary washing machine appliance according to one or more additional exemplary embodiments of the present disclosure.

In some embodiments, e.g., as illustrated in FIG. 7, the washing machine appliance 100 may include a second humidity sensor 209. In such embodiments, the second humidity sensor 209 may be positioned proximate to the damper 210, such as immediately upstream or immediately downstream (as depicted in FIG. 7) of the damper 210, e.g., between the damper 210 and the gasket 200 or between the damper 210 and the aperture 202. In such embodiments, the first humidity sensor 208 may be used to measure the humidity within the washing machine appliance 100, and the second humidity sensor 209 may be used to measure the ambient humidity.

Figure 8:
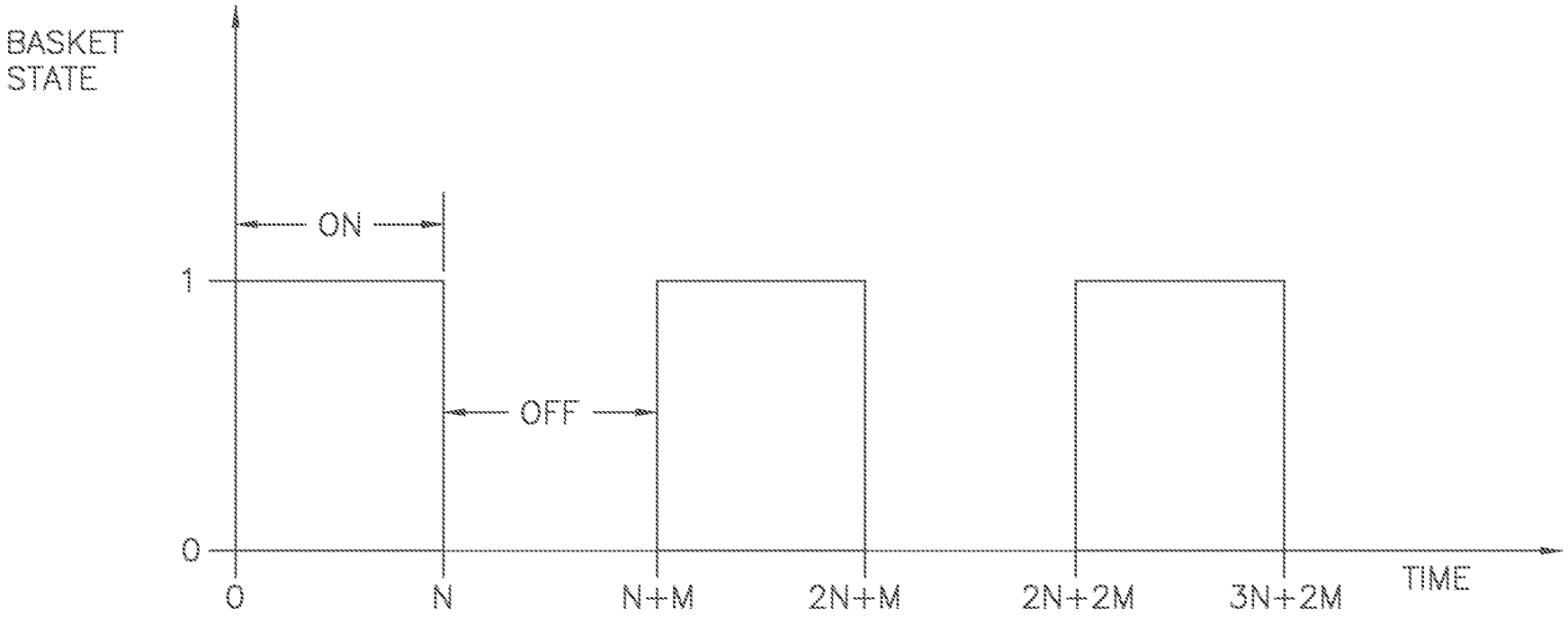
FIG. 8 provides a graph of multiple stages of an exemplary ventilation cycle for a washing machine appliance according to one or more embodiments of the present disclosure.

As mentioned above, the flow of ambient air 1000 (e.g., FIG. 3) through the washing machine appliance 100 may be facilitated by rotating the wash basket 122. In some embodiments, such rotation may include, e.g., during a ventilation cycle, example embodiments of which will be described below, rotating the basket 122 for an ON period followed by stopping the basket 122 for an OFF period. As illustrated in FIG. 8, the basket state (vertical axis) 1 represents ON or rotating, e.g., by the motor 130, and 0 represents OFF or stopped. In various embodiments, the rotational speed during the ON period (when basket state=1) may be any suitable speed, such as between about 50 RPM and about 200 RPM, such as about 150 RPM or about 100 RPM. The rotational speed during the ON period may be generally constant, e.g., apart from an inherent acceleration time to reach the set speed. As is understood, the rotational speed is zero during the OFF period.

The ON period may have a duration of N minutes. For example, N may be between about five minutes and about forty-five minutes, such as between about ten minutes and about twenty minutes, such as about fifteen minutes. After the ON period, e.g., at time equals N minutes, where the cycle start is at time equals zero minutes, the wash basket 122 may be stopped for an OFF period having a duration of M minutes. In various embodiments, M minutes may be any value within the ranges described above for N, e.g., between about five minutes and about forty-five minutes, such as between about ten minutes and about twenty minutes, such as about fifteen minutes, and in some embodiments, M may be equal to N. After the OFF period, e.g., at time equals N+M (which may also be 2N when M=N), the ventilation cycle may continue with an additional or repeated rotating step, e.g., another ON period having a duration of N minutes, where the second ON period ends at time equals 2N+M (or 3N, when M=N). As illustrated in FIG. 8, the cycle may then continue with any number of iterations of the ON period and OFF period, e.g., three iterations as illustrated in FIG. 8.

Figure 9:
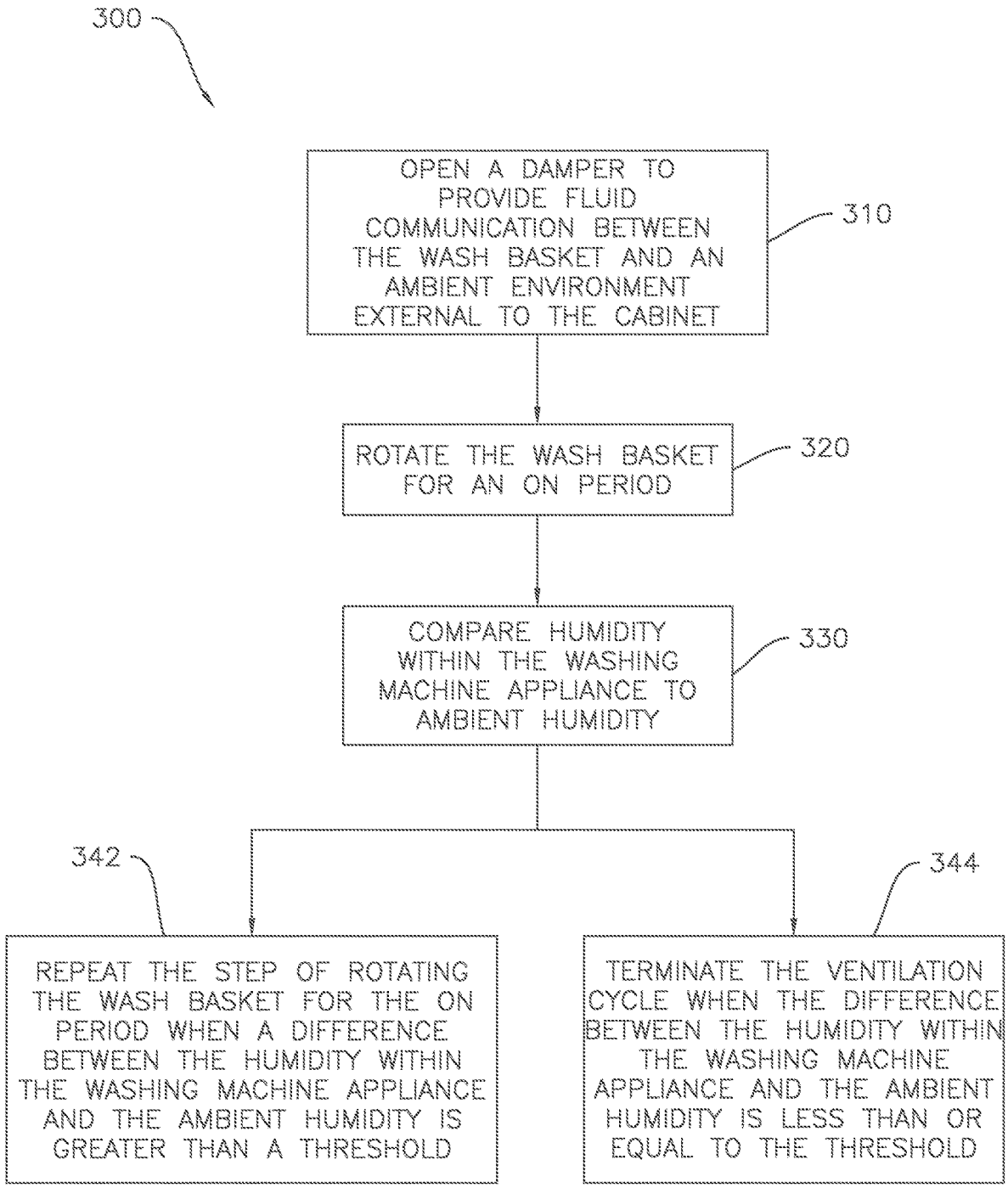
FIG. 9 provides a flow diagram of an exemplary method of ventilating a washing machine appliance according to one or more exemplary embodiments of the present disclosure.

FIG. 9 provides an exemplary method 300 of ventilating a washing machine appliance, e.g., operating a washing machine appliance in a ventilation cycle, according to one or more exemplary embodiments of the present disclosure. In this way, moisture trapped within a wash chamber may be removed. If articles are present in the wash chamber, moisture may likewise be removed from the articles. Method 300 can be implemented using any suitable appliance, including for example, horizontal axis washing machine appliance 100 of FIGS. 1 and 2. Accordingly, to provide context to method 300, reference numerals utilized to describe the features of washing machine appliance 100 in FIGS. 1 and 2 will be used below.

The method 300, e.g., ventilation cycle, may be begun or commenced in various ways. As will be understood, the ventilation cycle may be performed after or between wash cycles of washing machine appliance 100. The ventilation cycle may be commenced in a number of suitable ways. For instance, a user may manually commence the ventilation cycle. For example, a user may manipulate one or more input selectors 182 of control panel 180. As another example, a user may activate the ventilation cycle by utilizing an application on a remote user device, e.g., smartphone, tablet, etc., communicatively coupled with controller 186 of washing machine appliance 100. Another suitable manner for commencing the ventilation cycle includes automatically commencing the ventilation cycle without a specific user input. For example, the ventilation cycle may be commenced automatically at a predetermined interval, such as e.g., every week, every month, etc. In this manner, the ventilation cycle may be performed without user interaction with washing machine appliance 100 and it may be ensured that wash tub 120 and other internal components are "dried out" at regular intervals. As another example, the ventilation cycle may be commenced automatically after a wash cycle is performed. In this way, the moisture-laden articles disposed within wash basket 122 may begin drying immediately after the completion of a wash cycle. Yet another suitable manner for commencing the ventilation cycle includes embedding the ventilation cycle into another cycle, such as e.g., a basket clean cycle in which the basket 122 is self-cleaned. The embedded ventilation cycle may be performed after the basket clean cycle, for example. In this way, when such other cycles are selected by a user or run automatically by washing machine appliance 100, the ventilation cycle is likewise performed.

As illustrated in FIG. 9, the method 300 may include a step 310 of opening a damper positioned within the cabinet of the washing machine appliance between the door and the wash basket to provide fluid communication between the wash basket and an ambient environment external to the cabinet. The damper may be upstream of the wash basket with respect to a flow of ambient air from the ambient environment external to the cabinet through the washing machine appliance, e.g., such as the damper 210 illustrated in FIG. 3 which is upstream of wash basket 122 with respect to the flow of ambient air 1000 through the washing machine appliance 100. It will be recognized by those of ordinary skill in the art that the step 310 is optional in at least some exemplary embodiments of the present disclosure, such as embodiments where the damper is not included in the washing machine appliance.

Method 300 may further include a step 320 of rotating the wash basket. The step 320 may be performed after opening the damper 210 and/or while the damper 210 is open to permit the ambient air 1000 into the washing machine appliance 100 (e.g., in embodiments where the damper 210 is provided). The wash basket may be rotated during step 320 for an ON period. For example, the ON period may have a duration of N minutes, as described above with respect to FIG. 8. As a result of such rotation of the wash basket 122, the flow of ambient air 1000 is drawn through the damper 210 from the ambient environment into internal components of the washing machine appliance 100, e.g., the wash basket 122, and the flow of ambient air 1000 is then urged into the vent line 190 extending between the wash basket and the cabinet. As mentioned, the vent line 190 is downstream of the wash basket 122 with respect to the flow of ambient air 1000 through the damper 210 from the ambient environment.

As mentioned, controller 186 may be operable to measure air humidity, e.g., by receiving a signal indicative of a relative humidity of the air within the washing machine appliance 100 and/or of air in the ambient environment outside of the cabinet 102. Based on the signals received, controller 186 may determine the relative humidity of such air. Also as mentioned above, both the humidity within the washing machine appliance and the ambient humidity of the ambient environment may be measured, such as both with the single humidity sensor 208, also as described above. In various embodiments, the method 300 may include comparing a humidity within the washing machine appliance to a reference humidity value, such as determining a mathematical difference, e.g., by subtracting the reference humidity value from the internal humidity, between the humidity within the washing machine appliance and the reference humidity value. The mathematical difference between the humidity within the washing machine appliance and the reference humidity value may then be compared to or checked against a threshold, e.g., to determine whether the difference is greater than the threshold or is less than or equal to the threshold.

In some embodiments, the reference humidity value may be an ambient humidity of the ambient environment. In other embodiments, the reference humidity value may be an internal humidity within the washing machine appliance. For example, the reference humidity value may be a maximum humidity, e.g., a maximum humidity measured at the start of the ventilation cycle. For example, measuring the maximum humidity at the start of the ventilation cycle may include measuring the humidity in the washing machine appliance at the start of the ON period, e.g., at the start of the first or initial ON period in instances where the rotating step is iterated. In some exemplary embodiments where the reference humidity value is the maximum humidity, the threshold may reflect a humidity drop during the ON period by certain amount as a check to stop the cycle. For example, at the start of ventilation cycle, the max humidity may be 95%, and the threshold may be about 20% or about 25%, such that the ventilation cycle would be terminated when the humidity within the washing machine appliance drops to about 75% or about 70%.

Based on such comparison, the method 300 may then proceed to a step 342 of repeating the step of rotating the wash basket for the ON period when the difference between the humidity within the washing machine appliance and the reference humidity value, e.g., the ambient humidity or the maximum humidity, is greater than a threshold. When the difference between the humidity within the washing machine appliance and the ambient humidity is less than or equal to the threshold, which may be after multiple iterations of the step 320 of rotating the basket for the ON period, and which may also include an equal number of iterations of an OFF period, as described above with respect to FIG. 8, the method 300 then terminates at step 344, e.g., the wash tub 120, wash basket 122, and any articles which may be therein are determined to be dry and/or as dry as possible given the ambient humidity.

Embodiments of the present disclosure where the ventilation cycle is terminated based on the compared humidity values provide numerous advantages. For example, the overall length (time duration) of the ventilation cycle may be significantly shorter as compared to passive ventilation cycles which last for several hours, such as up to about eight hours to complete. Additionally, where the present methods and ventilation cycles may be performed with the door closed, e.g., the entire method is performed while the door is closed, the exemplary methods and cycles of the present disclosure provide advantages over ventilation methods which require the door to be open, such as preventing the door from intruding into otherwise usable space within a room during the ventilation cycle, etc. Moreover, the ventilation cycles and methods disclosed herein may be advantageously quicker, e.g., shorter time duration, than passive ventilation methods that do not incorporate or respond to humidity measurements.

In some embodiments, the humidity within the washing machine appliance may be measured during the ON period of step 320, such as at the end of the ON period, and the step 330 of comparing the humidity within the washing machine appliance to the reference humidity value may be performed immediately after the ON period. For example, step 330 may be performed at time equals N minutes (FIG. 8). When the step 330 is performed at time equals N minutes and the difference between the humidity within the washing machine appliance and the reference humidity value is greater than the threshold, the method 300 may then repeat the step 320 of rotating the basket for the ON period, which may include stopping the basket for an OFF period of M minutes (FIG. 8) after the ON period before repeating the rotating step 320. As mentioned above, when the difference between the humidity within the washing machine appliance and the reference humidity value is less than or equal to the threshold, the method or ventilation cycle may be terminated, e.g., as indicated at step 344 in FIG. 9.

In some embodiments, the humidity within the washing machine appliance may be measured during the ON period of step 320, e.g., at the end of the ON period, at time equals N minutes (FIG. 8). When the internal humidity is measured at time equals N minutes, the comparing step 330 may be performed immediately thereafter. In such embodiments, similar to those embodiments described above, when the difference between the humidity within the washing machine appliance and the reference humidity value is greater than the threshold, the method 300 may then repeat the step 320 of rotating the basket for the ON period, which may include stopping the basket for an OFF period of M minutes (FIG. 8) after the ON period before repeating the rotating step 320. Also as mentioned above, when the difference between the humidity within the washing machine appliance and the reference humidity value is less than or equal to the threshold, the method or ventilation cycle may be terminated, e.g., as indicated at step 344 in FIG. 9.

Further, when the method 300 does repeat step 320 for one or more additional iterations, a second check may be incorporated before terminating the ventilation cycle. The second check may include comparing the old internal humidity to a new internal humidity. For example, the old internal humidity, which may also be referred to as the original internal humidity, may be the stored value corresponding to the internal humidity measured at the end of the first ON period or the immediately preceding ON period, e.g., at time equals N minutes, and the new internal humidity may be measured at the end of the current ON period, e.g., where the old internal humidity corresponds to time equals N minutes, the new internal humidity would be at time equals 2N+M minutes (FIG. 8, which may also be 3N minutes, where M=N). Also, after further iterations (if any) the humidity at 2N+M minutes becomes the old humidity, e.g., when the new humidity is measured at time equals 3N+2M minutes (FIG. 8). Thus, in some embodiments, method 300 may also include, when the difference between the humidity within the washing machine appliance and the reference humidity value is greater than the threshold, measuring a new humidity within the washing machine appliance during (while) repeating the step of rotating the wash basket for the ON period, such as at the end of the repeat ON period, followed by comparing the new humidity within the washing machine appliance to the original humidity within the washing machine appliance and comparing the new humidity within the washing machine appliance to the reference humidity value. In such embodiments, the method 300 is only terminated when both conditions are satisfied, e.g., when both the change in humidity from one cycle to the next is within a tolerance range and the difference between the internal humidity (the most recently measured internal humidity) and the reference humidity value is less than or equal to the threshold. In other words, the method 300 may include repeating the step of rotating the wash basket for the ON period when at least one of the checks is not met, e.g., when (i) a difference between the new humidity within the washing machine appliance and the reference humidity value is greater than the threshold, and/or (ii) when a difference between the new humidity within the washing machine appliance and the original humidity within the washing machine appliance is outside of a tolerance range. In such embodiments, the method 300 may proceed to the step 344 of terminating the ventilation cycle only when both checks are satisfied, e.g., when the difference between the new humidity within the washing machine appliance and the reference humidity value is less than or equal to the threshold and the difference between the new humidity within the washing machine appliance and the original humidity within the washing machine appliance is within the tolerance range.

In some embodiments, the humidity within the washing machine appliance may be measured during the OFF period. For example, the humidity within the washing machine appliance may be continuously monitored during the OFF period and the humidity within the washing machine appliance measured during the OFF period may be an average humidity value during the OFF period. Moreover, when the ON period is repeated, the OFF period may be repeated as well, e.g., embodiments of method 300 may include repeating the step of stopping the wash basket for the OFF period after repeating the step of rotating the wash basket for the ON period when the difference between the humidity within the washing machine appliance and the reference humidity value is greater than the threshold. When the humidity within the washing machine appliance is measured during the OFF period, the step of comparing the humidity within the washing machine appliance to the reference humidity value may be performed during the OFF period, e.g., at the end of the OFF period, at time equals N+M (FIG. 8), such as just before the next ON period, where performing the next ON period may be based on or conditional upon the comparison. Such embodiments may also include a second check, such as comparing the OFF humidity measured during the OFF period, e.g., the average humidity measured during the OFF period, to an ON humidity measured at the end of the ON period, e.g., at time equals N minutes (FIG. 8). In such embodiments, the method 300 is only terminated when both conditions are satisfied, e.g., when both the change in humidity during the OFF period, e.g., the difference between the ON humidity and the OFF humidity, is within a tolerance range and the difference between the OFF humidity and the reference humidity value is less than or equal to the threshold. In other words, the method 300 may include repeating the step of rotating the wash basket for the ON period when at least one of the checks is not met, e.g., when (i) the difference between the OFF humidity within the washing machine appliance and the reference humidity value is greater than the threshold, and/or (ii) when a difference between the OFF humidity within the washing machine appliance and the ON humidity within the washing machine appliance is outside of a tolerance range. In such embodiments, the method 300 may proceed to the step 344 of terminating the ventilation cycle only when both checks are satisfied, e.g., when the difference between the OFF humidity within the washing machine appliance and the reference humidity value is less than or equal to the threshold and the difference between the OFF humidity within the washing machine appliance and the ON humidity within the washing machine appliance is within the tolerance range.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of ventilating a washing machine appliance, the washing machine appliance comprising a cabinet, a humidity sensor positioned inside the cabinet, an aperture defined through the cabinet, a wash tub positioned within the cabinet, a wash basket rotatably mounted within the wash tub and accessible through an opening in the cabinet, and a door pivotably mounted to the cabinet whereby the door is pivotable between an open position and a closed position, wherein the door permits access to the wash basket through the opening when in the open position and encloses the wash basket within the cabinet when in the closed position, and wherein the aperture is open to an ambient environment external to the cabinet when the door is in the closed position, the method comprising:

measuring a humidity within the washing machine appliance with the humidity sensor positioned inside the cabinet;

rotating the wash basket for an ON period, whereby a flow of ambient air is drawn through the aperture from the ambient environment into the wash basket, and the flow of ambient air is urged into a vent line extending between the wash basket and the cabinet downstream of the wash basket with respect to the flow of ambient air through the aperture from the ambient environment;

comparing the humidity within the washing machine appliance to a reference humidity value, wherein the reference humidity value is a maximum humidity within the washing machine appliance measured at the start of the ON period with the humidity sensor positioned inside the cabinet of the washing machine appliance;

repeating the step of rotating the wash basket for the ON period when a difference between the humidity within the washing machine appliance and the reference humidity value is greater than a threshold; and terminating the method when the difference between the humidity within the washing machine appliance and the reference humidity value is less than or equal to the threshold.

2. The method of claim 1, wherein the entire method is performed while the door is closed.

3. The method of claim 1, further comprising, prior to rotating the wash basket for the ON period, opening a damper positioned within the cabinet of the washing machine appliance between the door and the wash basket to provide fluid communication between the wash basket and the ambient environment external to the cabinet, wherein the damper is downstream of the aperture and upstream of the wash basket with respect to the flow of ambient air from the ambient environment external to the cabinet through the washing machine appliance.

4. The method of claim 3, wherein the humidity sensor positioned inside the cabinet is positioned in the vent line of the washing machine appliance, wherein the method further comprises closing the damper and activating a drain pump of the washing machine appliance, whereby ambient air is drawn into the vent line of the washing machine appliance, and measuring the ambient humidity of the ambient environment external to the cabinet with the humidity sensor positioned in the vent line of the washing machine appliance while the damper is closed and the drain pump is activated.

5. The method of claim 1, wherein the humidity within the washing machine appliance is measured during the ON period, and wherein the step of comparing the humidity within the washing machine appliance to the reference humidity value is performed immediately after the ON period.

6. The method of claim 1, wherein the step of comparing the humidity within the washing machine appliance to the reference humidity is performed immediately after the ON period.

7. The method of claim 1, wherein the humidity within the washing machine appliance is an original humidity within the washing machine appliance measured during the ON period, wherein the step of comparing the humidity within the washing machine appliance to the reference humidity value is performed immediately after the ON period, the method further comprising:

repeating the step of rotating the wash basket for the ON period;

measuring a new humidity within the washing machine appliance during repeating the step of rotating the wash basket for the ON period;

comparing the new humidity within the washing machine appliance to the original humidity within the washing machine appliance;

comparing the new humidity within the washing machine appliance to the reference humidity value;

repeating the step of rotating the wash basket for the ON period when a difference between the new humidity within the washing machine appliance and the reference humidity value is greater than the threshold or when a difference between the new humidity within the washing machine appliance and the original humidity within the washing machine appliance is outside of a tolerance range; and terminating the method when the difference between the new humidity within the washing machine appliance and the reference humidity value is less than or equal to the threshold and the difference between the new humidity within the washing machine appliance and the original humidity within the washing machine appliance is within the tolerance range.

8. The method of claim 1, further comprising stopping the wash basket for an OFF period after rotating the wash basket for the ON period, wherein the humidity within the washing machine appliance is an OFF humidity within the washing machine appliance measured during the OFF period, and wherein the step of comparing the humidity within the washing machine appliance to the reference humidity value is performed immediately after the OFF period, further comprising:

measuring an ON humidity within the washing machine appliance during the ON period;

comparing the ON humidity within the washing machine appliance to the OFF humidity within the washing machine appliance;

repeating the step of rotating the wash basket for the ON period and the step of stopping the wash basket for the OFF period when the difference between the OFF humidity within the washing machine appliance and the reference humidity is greater than the threshold or when a difference between the OFF humidity within the washing machine appliance and the ON humidity within the washing machine appliance is outside of a tolerance range; and terminating the method when the difference between the OFF humidity within the washing machine appliance and the reference humidity is less than or equal to the threshold and the difference between the OFF humidity within the washing machine appliance and the ON humidity within the washing machine appliance is within the tolerance range.

9. The method of claim 1, wherein the humidity sensor positioned inside the cabinet is a first humidity sensor positioned in the vent line of the washing machine appliance, wherein the humidity within the washing machine appliance is measured with the first humidity sensor positioned in the vent line of the washing machine appliance, and wherein the reference humidity value is measured with a second humidity sensor proximate the aperture.

10. A washing machine appliance comprising:

a cabinet;

an aperture defined through the cabinet;

a wash tub positioned within the cabinet;

a wash basket rotatably mounted within the wash tub and accessible through an opening in the cabinet;

a door pivotably mounted to the cabinet whereby the door is pivotable between an open position and a closed position, wherein the door permits access to the wash basket through the opening when in the open position and encloses the wash basket within the cabinet when in the closed position, and wherein the aperture is open to an ambient environment external to the cabinet when the door is in the closed position;

a vent line extending between the wash basket and the cabinet;

a damper positioned within the cabinet of the washing machine appliance between the door and the wash basket to provide fluid communication between the wash basket and the ambient environment external to the cabinet; and a controller, the controller operable to perform a ventilation cycle, the ventilation cycle comprising:

rotating the wash basket for an ON period, whereby a flow of ambient air is drawn through the aperture from the ambient environment into the wash basket and is urged into the vent line, whereby the vent line is downstream of the wash basket with respect to the flow of ambient air from the ambient environment external to the cabinet through the aperture;

comparing a humidity within the washing machine appliance to a reference humidity value;

repeating the step of rotating the wash basket for the ON period when a difference between the humidity within the washing machine appliance and the reference humidity value is greater than a threshold;

opening the damper prior to rotating the wash basket for the ON period, wherein the damper is downstream of the aperture and upstream of the wash basket with respect to the flow of ambient air from the ambient environment external to the cabinet through the washing machine appliance; and terminating the ventilation cycle when the difference between the humidity within the washing machine appliance and the reference humidity value is less than or equal to the threshold.

11. The washing machine appliance of claim 10, wherein the controller is operable to perform the entire ventilation cycle while the door is closed.

12. The washing machine appliance of claim 10, wherein the ventilation cycle further comprises measuring the humidity within the washing machine appliance with a humidity sensor positioned in the vent line of the washing machine appliance wherein the reference humidity value is an ambient humidity of the ambient environment, and wherein the controller is operable for, during the ventilation cycle, measuring the ambient humidity of the ambient environment external to the cabinet with the humidity sensor positioned in the vent line of the washing machine appliance by closing the damper and activating a drain pump of the washing machine appliance, whereby ambient air is drawn into the vent line of the washing machine appliance.

13. The washing machine appliance of claim 10, wherein the controller is operable to measure the reference humidity value when the washing machine is in an idle state, to measure the humidity within the washing machine appliance during the ON period, and to compare the humidity within the washing machine appliance to the reference humidity value immediately after the ON period.

14. The washing machine appliance of claim 10, wherein the controller is operable to measure the reference humidity value during the ON period, and to compare the humidity within the washing machine appliance to the reference humidity value immediately after the ON period.

15. The washing machine appliance of claim 10, wherein the humidity within the washing machine appliance is an original humidity within the washing machine appliance, wherein the controller is operable to measure the humidity within the washing machine appliance during the ON period, and to compare the humidity within the washing machine appliance to the reference humidity value immediately after measuring the humidity within the washing machine appliance, and wherein the ventilation cycle further comprises:

repeating the step of rotating the wash basket for the ON period;

measuring a new humidity within the washing machine appliance during repeating the step of rotating the wash basket for the ON period;

comparing the new humidity within the washing machine appliance to the original humidity within the washing machine appliance;

comparing the new humidity within the washing machine appliance to the reference humidity value;

repeating the step of rotating the wash basket for the ON period when a difference between the new humidity within the washing machine appliance and the reference humidity value is greater than the threshold or when a difference between the new humidity within the washing machine appliance and the original humidity within the washing machine appliance is outside of a tolerance range; and terminating the ventilation cycle when the difference between the new humidity within the washing machine appliance and the reference humidity value is less than or equal to the threshold and the difference between the new humidity within the washing machine appliance and the original humidity within the washing machine appliance is within the tolerance range.

16. The washing machine appliance of claim 10, wherein the ventilation cycle further comprises stopping the wash basket for an OFF period after rotating the wash basket for the ON period, wherein the reference humidity value is measured when the washing machine is in an idle state, wherein the humidity within the washing machine appliance is an OFF humidity within the washing machine appliance measured during the OFF period, and wherein the step of comparing the humidity within the washing machine appliance to the reference humidity value is performed immediately after the OFF period, and wherein the ventilation cycle further comprises:

measuring an ON humidity within the washing machine appliance during the ON period;

comparing the ON humidity within the washing machine appliance to the OFF humidity within the washing machine appliance;

repeating the step of rotating the wash basket for the ON period and the step of stopping the wash basket for the OFF period when the difference between the OFF humidity within the washing machine appliance and the reference humidity value is greater than the threshold or when a difference between the OFF humidity within the washing machine appliance and the ON humidity within the washing machine appliance is outside of a tolerance range; and terminating the ventilation cycle when the difference between the OFF humidity within the washing machine appliance and the reference humidity value is less than or equal to the threshold and the difference between the OFF humidity within the washing machine appliance and the ON humidity within the washing machine appliance is within the tolerance range.

17. The washing machine appliance of claim 10, wherein the humidity within the washing machine appliance is measured with a first humidity sensor positioned in the vent line of the washing machine appliance, and wherein the reference humidity value is measured with a second humidity sensor proximate the aperture.

18. The washing machine appliance of claim 10, wherein the ventilation cycle further comprises measuring the humidity within the washing machine appliance with a humidity sensor positioned inside the cabinet of the washing machine appliance, and wherein the reference humidity value is a maximum humidity within the washing machine appliance measured at the start of the ON period with the humidity sensor positioned inside the cabinet of the washing machine appliance.

19. A method of ventilating a washing machine appliance, the washing machine appliance comprising a cabinet, an aperture defined through the cabinet, a wash tub positioned within the cabinet, a wash basket rotatably mounted within the wash tub and accessible through an opening in the cabinet, and a door pivotably mounted to the cabinet whereby the door is pivotable between an open position and a closed position, wherein the door permits access to the wash basket through the opening when in the open position and encloses the wash basket within the cabinet when in the closed position, and wherein the aperture is open to an ambient environment external to the cabinet when the door is in the closed position, the method comprising:

measuring a reference humidity value when the washing machine appliance is in an idle state;

rotating the wash basket for an ON period, whereby a flow of ambient air is drawn through the aperture from the ambient environment into the wash basket, and the flow of ambient air is urged into a vent line extending between the wash basket and the cabinet downstream of the wash basket with respect to the flow of ambient air through the aperture from the ambient environment;

measuring a humidity within the washing machine appliance during the ON period;

comparing the humidity within the washing machine appliance to the reference humidity value immediately after the ON period;

repeating the step of rotating the wash basket for the ON period when a difference between the humidity within the washing machine appliance and the reference humidity value is greater than a threshold; and terminating the method when the difference between the humidity within the washing machine appliance and the reference humidity value is less than or equal to the threshold.

20. The method of claim 19, wherein the humidity within the washing machine appliance measured during the ON period is an original humidity within the washing machine appliance, further comprising:

repeating the step of rotating the wash basket for the ON period;

measuring a new humidity within the washing machine appliance during repeating the step of rotating the wash basket for the ON period;

comparing the new humidity within the washing machine appliance to the original humidity within the washing machine appliance;

comparing the new humidity within the washing machine appliance to the reference humidity value;

repeating the step of rotating the wash basket for the ON period when a difference between the new humidity within the washing machine appliance and the reference humidity value is greater than the threshold or when a difference between the new humidity within the washing machine appliance and the original humidity within the washing machine appliance is outside of a tolerance range; and terminating the method when the difference between the new humidity within the washing machine appliance and the reference humidity value is less than or equal to the threshold and the difference between the new humidity within the washing machine appliance and the original humidity within the washing machine appliance is within the tolerance range.

* * * * *